US005850639A

United States Patent [19]

Arita et al.

[11] Patent Number: 5,850,639

[45] Date of Patent: Dec. 22, 1998

[54] TANK DEVICE FOR FLUSHING TOILET BOWL

[75] Inventors: Kinya Arita; Shinji Shibata; Hiroyuki Matsushita, all of Kitakyushu, Japan

[73] Assignee: Toto Ltd., Fukuoka-ken, Japan

[21] Appl. No.: 732,288

[22] PCT Filed: Aug. 16, 1995

[86] PCT No.: PCT/JP95/01626

§ 371 Date: Oct. 28, 1996

§ 102(e) Date: Oct. 28, 1996

[87] PCT Pub. No.: WO96/27052

PCT Pub. Date: Jun. 9, 1996

[30] Foreign Application Priority Data

Feb. 28, 1995 [JP] Japan ..... 7/40462

[51] Int. Cl.[6] ..... E03D 1/34

[52] U.S. Cl. ..... 4/388; 4/379

[58] Field of Search ..... 4/393, 379, 380, 4/381, 382, 388, 394, 395, 324, 326, 327

[56] References Cited

U.S. PATENT DOCUMENTS

| | | | |
|---|---|---|---|
| 2,270,989 | 1/1942 | Asselin | 4/382 |
| 3,142,846 | 8/1964 | Lackenmaier et al. | 4/393 |
| 3,964,109 | 6/1976 | Street et al. | 4/327 |
| 4,134,165 | 1/1979 | Phripp et al. | 4/379 |
| 4,483,024 | 11/1984 | Troeh | 4/381 |
| 4,910,813 | 3/1990 | Applegart | 4/393 |
| 5,293,650 | 3/1994 | Schoepe et al. | 4/379 |
| 5,673,441 | 10/1997 | Wang | 4/388 |

FOREIGN PATENT DOCUMENTS

| | | |
|---|---|---|
| 149543 | 12/1974 | Japan . |
| 47439 | 4/1977 | Japan . |
| 56-70337 | 6/1981 | Japan . |
| 7-133624 | 5/1995 | Japan . |

*Primary Examiner*—David J. Walczak

*Attorney, Agent, or Firm*—Birch, Stewart, Kolasch & Birch, LLP

[57] ABSTRACT

A tank device for flushing a toilet bowl includes a tank body for storing toilet bowl-flushing water. The tank body has an opening at the bottom. One or more support arms are arranged within the tank body and are pivotally mounted to supports. A valve body is secured to one end of the support arms. The valve body comes into close contact with the opening of the tank body. A delaying structure for delaying a motion of the valve body is attached to the support arms. An activator for pulling up the valve body is fitted to the tank body. Delaying the valve closing motion of the valve body allows the stored water within the tank body to be used as flush water for the toilet bowl, until the stored water drops near the bottom.

17 Claims, 6 Drawing Sheets

TANK DEVICE FOR FLUSHING TOILET BOWL

TECHNICAL FIELD

This invention relates to a tank device for flushing a toilet bowl and, more particularly, a tank device which allows an amount of water remaining in the tank after a discharge of flush water to be made smaller and, further, allows the stored water in the tank to be efficiently used as flush water.

BACKGROUND ART

In a tank device for storing flush water (tank device for flushing a toilet bowl) used for a flush toilet bowl, an attempt has been made to make a tank body smaller in size from the requirements of saving water, restricting the height and dimensions. In order to make the tank body smaller in size, it is necessary to efficiently use the water stored in the tank. Previously, attempts have been made to release an amount of water remaining in the tank after a discharge of flush water, in order to efficiently use the stored water in the tank. For example, in the invention described in JP-A Sho-60-27780, a discharge valve, provided in the tank, is constructed so that it closes the valve later than the drop of a water level in the tank.

In this known tank device, a float chamber provided with a small hole at the bottom thereof is formed in the tank and is made to communicate with the interior of the tank through the small hole. When the water level drops at the time of water discharge, the drop of the water level in the float chamber occurs later than that of the water level in the tank. A float connected to a valve body of the discharge valve is housed in the float chamber and the timing when the float drops is delayed. After a discharge of the stored water in the tank is nearly finished, the valve body is adapted to be brought into a seating engagement with a discharge valve seat to close the discharge valve.

In the above-described known tank device, the discharge valve is complicated in construction and it is difficult to cause the float to smoothly drop within the float chamber. These is a problem in that a faulty motion of the discharge valve is apt to occur. Moreover the device is expensive.

The present invention has been made taking such points into consideration, and aims at providing a toilet bowl-flushing tank device having a delayed water discharge function which includes a discharge valve simple in construction and allowing a stable motion thereof to be performed.

SUMMARY OF THE INVENTION

In order to achieve the above-described object, a tank device for flushing a toilet bowl according to the present invention comprises

- a tank body for storing therein flush water for a toilet bowl, which has an opening at the bottom;
- one or more support arms arranged for swinging movement about pivotable supports within said tank body;
- a valve body secured to one end of said support arms and adapted to come into close contact with the opening of said tank body;
- a delaying means for delaying a motion of said valve body fitted to said support arms coming into close contact with the opening;
- a means for pulling up the valve body, which is fitted to said tank body and which gives to said valve body a motion of being moved away from said opening.

According to the present invention, the delaying means attached to the support arms allows a pivotable motion of the valve body toward the opening of the tank body to be delayed, thereby enabling the timing of when the valve body comes into close contact with the opening to be delayed. This allows the stored water within the tank body to be efficiently used as flush water for a toilet bowl.

According to a preferred form of the invention, the support arms have other ends extending in the direction opposite the valve body with the pivotable supports interposed therebetween, and a planar damping plate is secured to said other ends.

According to an another preferred form of the invention, the support arms between the valve body and the pivotable supports of the support arms comprise two members pivotably connected with each other.

According to a further preferred form of the invention, a delaying means for delaying the pivotable motion of the valve body toward the opening of the tank body is fitted to the pivotable supports of said support arms.

According to a further preferred form of the invention, the tank device for flushing a toilet bowl is equipped with one or more support arms having the other ends thereof extending in the direction opposite the valve body with the pivotable supports interposed therebetween, and an arm receiving part which is disposed within the tank body and which is formed with a longitudinal groove into which the front end portion at the other ends of the support arms is inserted from above, said longitudinal groove having a dimension of width which allows the front end portion at the other ends of the support arms to be shifted while being kept in contact therewith.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF EXPLANATION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Now, the embodiments of the present invention will be described with reference to the drawings.

Figure 1:
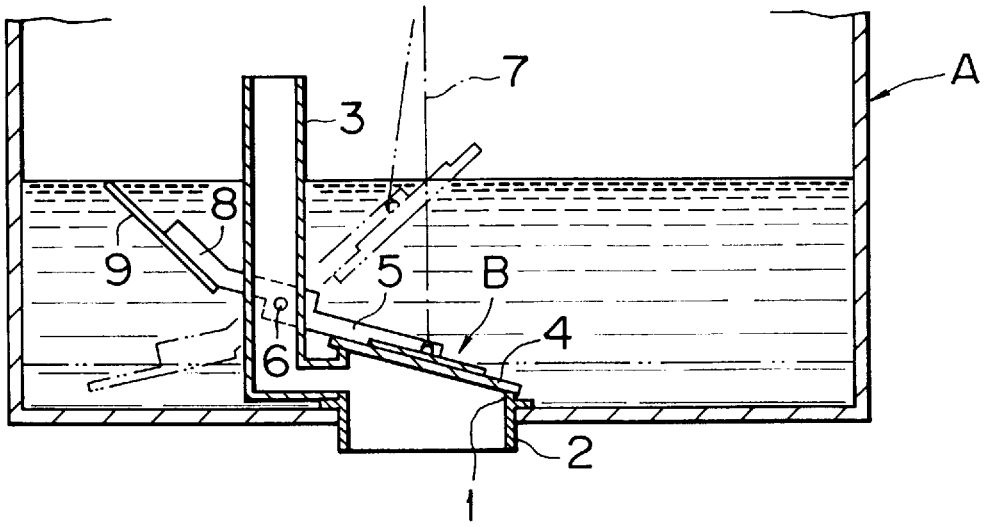
FIG. 1 is a sectional view showing a first embodiment of a toilet bowl-flushing tank device according to the present invention.
Figure 2:
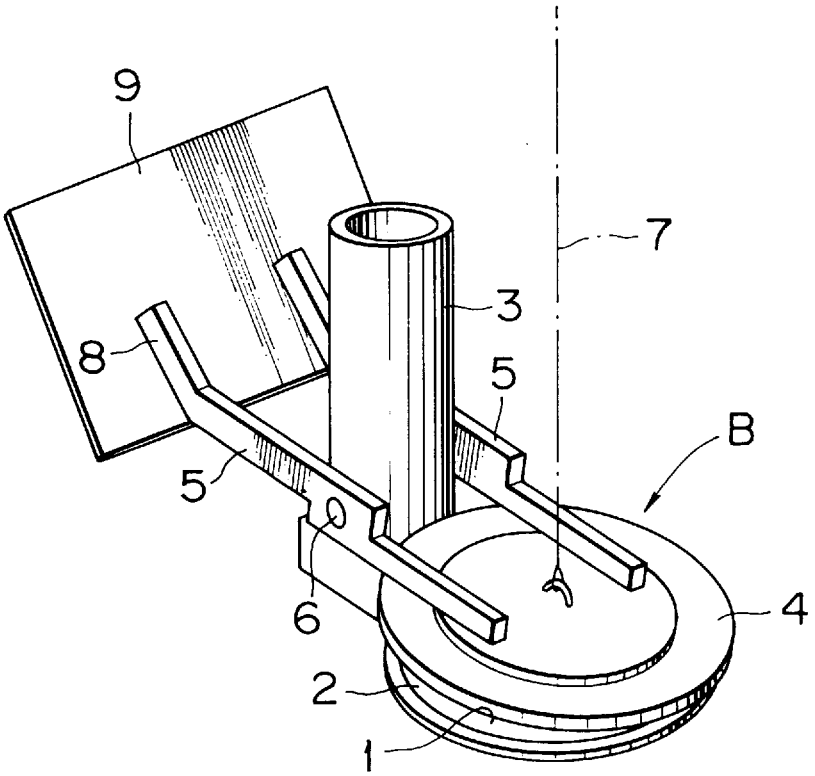
FIG. 2 is a perspective view showing the discharge valve of the embodiment shown in FIG. 1.
Figure 3:
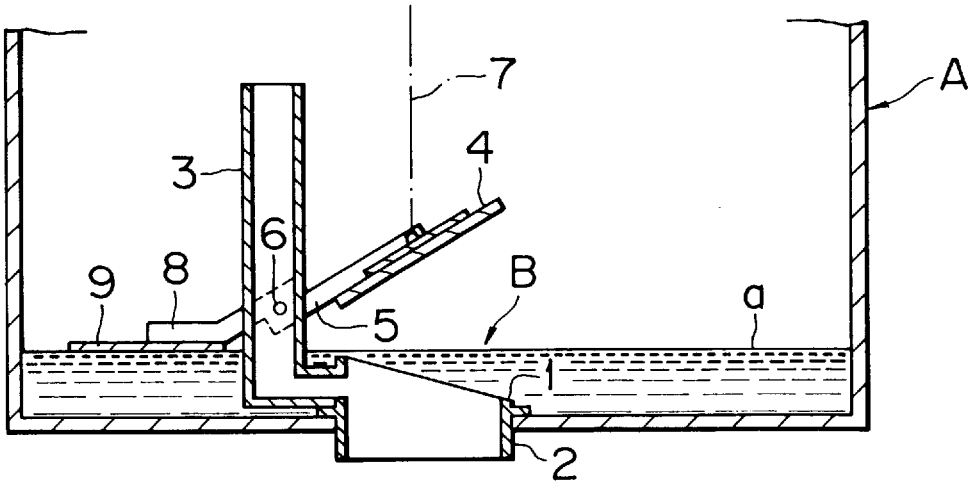
FIG. 3 is a sectional view showing the discharge valve while it is being closed.

FIGS. 1 to 3 are views showing a first embodiment of the present invention. In FIG. 1, reference character A indicates a tank body of a toilet bowl-washing tank device, at the bottom of which is provided a discharge valve B for discharging the stored flush water to supply it to a toilet bowl. The tank body A is further provided therein with a known water supply device such as a ball-cock supply valve to replenish flush water to the tank body A in which a water level drops due to a water discharge from the discharge valve B.

The discharge valve B includes a discharge valve body 2 which is fitted to the bottom of the tank body A so as to penetrate therethrough and which communicates with the toilet bowl outside the tank body A. On the upper end of the discharge valve body 2 protruding into the tank body A is formed a valve seat 1 comprising an oblique opening edge.

The discharge valve body 2 is provided with an overflow tube 3 rising from the side of the discharge valve body 2 and communicating at the lower end thereof with the discharge valve body 2. The overflow tube 3 also serves as a support for a valve body, and the valve body 4 corresponding to the valve seat 1 is pivotably connected to the base of the overflow tube 3.

As shown in FIG. 2, the valve body 4 is of a disk-like shape, and is provided on the upper surface thereof with a pair of support arms 5, 5 extending parallel to the upper surface. These arms 5, 5 are pivotably connected to the overflow tube 3 by means of a shaft 6, with the overflow tube 3 being held therebetween.

Accordingly, the valve body 4 is pivotably moved up and down about the pivotable supports of the arms 5, and an upward pivotable movement of the valve body 4 causes the same to be moved away from the valve seat 1 to open the discharge valve B, and a downward pivotable movement from the opened valve situation causes the valve body 4 to be brought into a seating engagement with the valve seat 1 to close the discharge valve B.

To the upper surface of the valve body 4 in the center thereof is connected an operating force-transmitting member 7, such as a chain, to transmit an operating force of an operating means (not shown) provided on the side wall of the tank body A to the valve body 4. When the operating means is operated, the valve body 4 is pulled up and pivotally moved in the upward direction, thereby allowing the discharge valve B to be opened.

The above-described pair of support arms 5, 5 further extend in the direction opposite the valve body 4 with respect to the pivotable supports (shafts 6 ) on the overflow tube 3, and are formed with damping plate-fitting portions at the forward ends thereof, to which a damping plate 9 is attached.

The damping plate-fitting portions 8 are bent so that the damping plate 9 is positioned near the bottom of the tank body A when a degree of opening the discharge valve is 45 to 70 degrees.

The damping plate 9 comprises a planar plate made of plastic or metal, and is rectangular in shape, as in the illustrated example, and is attached and fastened to the damping plate-fitting portions 8 of the support arms 5 by means of a suitable fixing means such as adhesive and screws.

In the toilet bowl-washing tank device with the above-described construction, when the discharge valve B is opened by operating the operating means to pull up the valve body 4, the damping plate 9 linked to the upward pivotable movement of the valve body 4 is pivotally moved downwardly toward the bottom of the tank body A.

The supply of flush water from the discharge valve B to the toilet bowl, which occurs by opening the discharge valve B, naturally produces a descending flow from above to below in the stored water within the tank body A; so, the upper surface of the damping plate 9 is subjected to the pressure of such descending flow.

As a result, the pressure of the above-mentioned descending flow applied to the upper surface of the damping plate 9 acts as a resistance against the motion of the valve body 4 attempting to drop due to gravity and to close the valve, so that the drop of the valve body 4 is suppressed, thereby causing the valve closing motion of the valve body 4 to be delayed.

As the descent of the water level within the tank proceeds along with the water discharge, the pressure which presses the damping plate 9 downwardly becomes smaller; so, the valve body 4 also is pivotably moved downwardly and a degree of opening the discharge valve B comes to be smaller. When a degree of opening the discharge valve B becomes a value of 25 to 50 degrees, the damping plate 9 comes to be parallel to the water surface "a", as shown in FIG. 3, and an adsorbing force drawn out by the surface tension functions between the damping plate 9 and the water level "a", so that the valve body 4 is continuously kept in an opened valve situation, thereby maintaining the degree of opening of the discharge valve B.

When the water level further descends and the damping plate 9 is entirely exposed to the space above the water surface, the surface tension adsorbing the damping plate 9 is lost and no pressure is applied to the upper surface of the damping plate 9, thus making it impossible to keep the valve body 4 in the raised condition and causing the valve body 4 to be pivotally moved downwardly to close the discharge valve B.

As described above, in this embodiment, the discharge valve B allows the motions of keeping the valve open at the two step positions to be performed, i.e., one motion due to the pressure of the descending flow applied to the damping plate 9 and the other due to the adsorbing force produced between the damping plate 9 and the water surface "a" when a degree of opening the discharge valve B becomes a value of 25 to 50 degrees.

In this embodiment, the larger the area of the damping plate 9 is, the more surely the delayed motion of the discharge valve B can be brought about; however, the numerical value thereof should be determined depending on a volume of the tank body A, a ratio of weight of the valve body 4 and the like.

In this connection, it has been confirmed by an experiment that if the damping plate 9 has a size of 85×125 mm in the case where a ratio of the valve body 4 to the damping plate 9 in weight is 2:1, as viewed from a fulcrum of the valve body 4, i.e., the pivotable supports (shafts 6) of the support arms 5, the reliable delayed motion is produced.

Further, the delayed motion at the valve closing time of the discharge valve B due to the above-described damping plate 9 can be controlled to a certain degree depending on the area of the damping plate 9. Namely, the valve closing timing of the discharge valve B can be delayed by making the area of the damping plate 9 larger. Moreover, also in the case where the valve seat 1 of the discharge valve B is small in the inner diameter and the descending flow occurring in the stored water within the tank is relatively weak, it can be coped with by making the area of the damping plate 9 larger.

As described above, the present embodiment performs the motion of keeping the discharge valve B open at two step positions; however, a construction of performing only the motion of keeping the valve open due to the pressure of the descending flow applied to the damping plate 9 is also possible. Also in this case, the delayed motion at the valve closing time of the discharge valve B due to the damping plate 9 can be controlled depending on the ratio of the valve body to the damping plate in weight or the area of the damping plate 9.

Moreover, the motion of delaying the valve closing due to an adsorbing force utilizing the surface tension produced between the damping plate 9 and the water surface "a" can be controlled by modifying the shape of the damping plate 9 by cutting the front half portion thereof, obliquely extending both the right and left ends, or by cutting the right and left of the front half portion thereof obliquely, respectively.

Namely, a water supply device such as a ball-cock supply valve usually starts to supply water at the same time the discharge of flush water from the tank starts, and when a pressure of water supply becomes high, the flow rate increases. In this case, since the descending speed of the water level of flush water within the tank is decreased, canceling the adsorbing force of the damping plate 9 is difficult; however, the damping plate 9, with the front half portion being cut, makes the adsorbing force at the front half portion of the plate smaller, and maintaining the valve body 4 in an open situation becomes difficult at this portion; so, the timing of delaying the valve closing utilizing the adsorbing force can be controlled. This makes it possible to prevent lateness in the timing of canceling the adsorbing force of the damping plate 9 and, therefore, the discharge valve B is kept in an opened valve situation for a period of time longer than the required time, thus resulting in a wasteful discharge of water.

In the case where the front half portion of the damping plate 9 is cut in this way, if the area of the damping plate 9 is adjusted to an area substantially the same as the case of the uncut front half portion of the plate, a force of resistance due to the descending flow of flush water at the time of water discharge becomes substantially the same as the case of the uncut front half portion of the plate.

Alternatively, changing the position where the damping plate 9 becomes horizontal with respect to the water surface within the tank allows the timing of producing and canceling the adsorbing force of the damping plate 9 to be adjusted. This alternative way makes it possible to prevent a wasteful discharge of water resulting from the fact that even if the area of the damping plate 9 is made larger to provide a stable delayed motion of the valve body 4, the discharge valve B is kept in the opened valve situation for a period of time longer than the required time similar to the above-described case.

Figure 4:
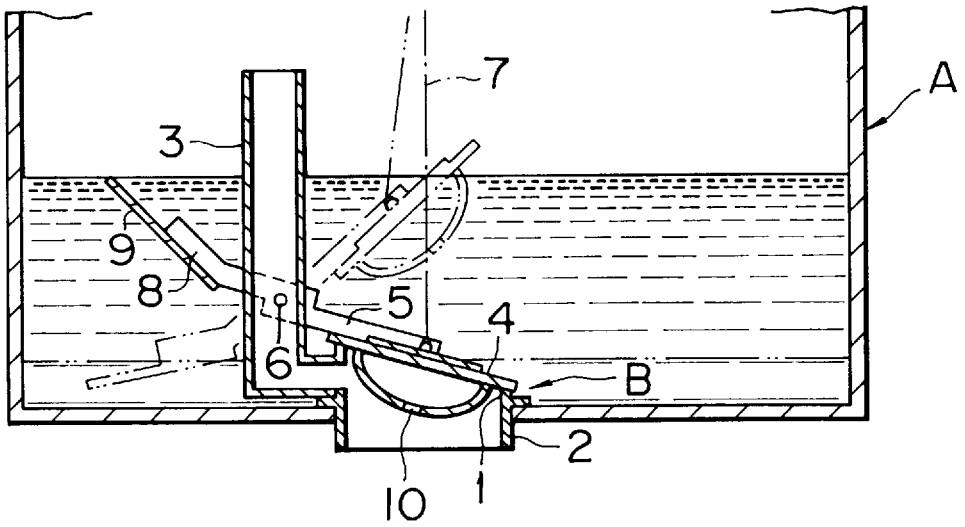
FIG. 4 is a sectional view showing a second embodiment of the present invention.

FIG. 4 shows a second embodiment of the present invention. A toilet bowl-flushing tank device according to the present embodiment is basically the same as the above-described embodiment provided with the damping plate 9, however, a float 10 comprising a structure with a specific gravity smaller than the specific gravity of water is further fitted to a valve body 4 of a discharge valve B.

According to the present embodiment, when a valve body 4 is pulled up, the pressure of the descending flow of flush water applied to a damping plate 9 acts as a resistance against the descending motion of the valve body 4 and suppresses a valve closing motion of the valve body 4, in a similar way to the above-described embodiment. Further, the buoyancy of the float 10 also suppresses the drop of the valve body 4.

For this reason, the present embodiment enables the area of the damping plate 9 to be made smaller compared with the above-described embodiment.

Figure 5:
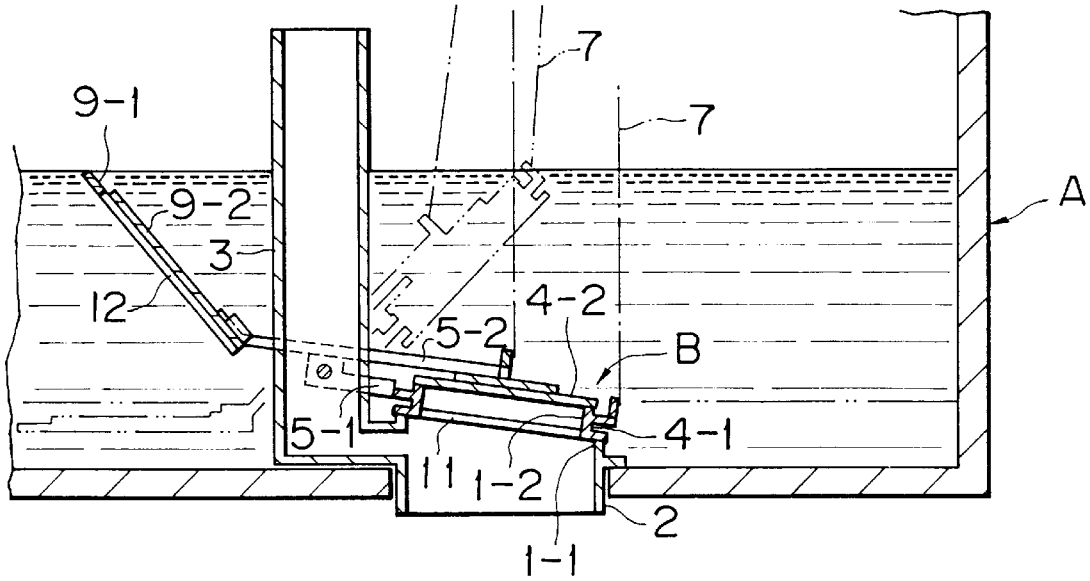
FIG. 5 is a sectional view showing a third embodiment of the present invention.
Figure 6:
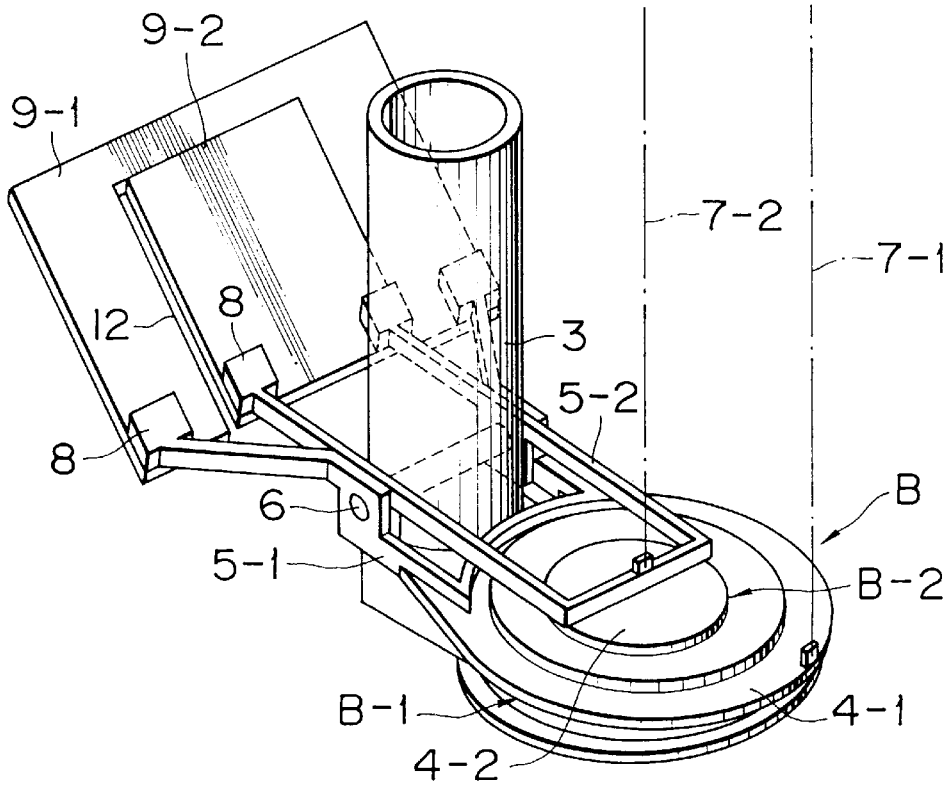
FIG. 6 is a perspective view showing the discharge valve of the embodiment shown in FIG. 5.

FIGS. 5 and 6 show a third embodiment of the present invention, in which a discharge valve B comprises damping plates connected to valve bodies 4, in a similar way to each of the above-described embodiments and, further, this embodiment can be used with a change-over means allowing large flushing for stool and small flushing for urine.

In this embodiment, the discharge valve B comprises a discharge valve B-1 for large flushing and a discharge valve B-2 for small flushing which are concentrically laid one on top of another, and a valve seat 1-1 of the discharge valve B-1 for large flushing (hereinafter referred to as large flushing valve seat) is formed on the upper end of the discharge valve body 2 provided so as to penetrate the bottom of the tank body A.

Further, a valve body 4-1 (hereinafter referred to as large flushing valve body) constituting the discharge valve B-1 for large flushing corresponding to the above-described large flushing valve seat 1-1 is of a disc-like shape and a pair of support arms 5-1 extend from the peripheral edge of the valve body. These support arms 5-1 are pivotably connected to an overflow tube 3 by a shaft 6, holding therebetween the overflow tube 3 provided on the discharge valve body 2.

A valve seat 1-2 of the discharge valve B-2 for small flushing (hereinafter referred to as small flushing valve seat) is formed on the above-described large flushing valve body 4-1 so as to be concentric with the large flushing valve seat 1-1 in a situation of the large flushing valve body 4-1 being in a seating engagement with the large flushing valve seat 1-1. A through-hole 11 provided in the large flushing valve body 4-1 and enclosed by the small flushing valve seat 1-2 is formed smaller in diameter than the opening of the large flushing valve seat 1-1.

Moreover, a valve body 4-2 (hereinafter referred to as small flushing valve body) constituting the discharge valve B-2 for small flushing corresponding in the small flushing valve seat 1-2 is of a disc-like shape in a similar way to the above-described large flushing valve body 4-1, and a pair of support arms 5-2 extend from the upper surface thereof and are pivotably connected to the overflow tube 3 by the shaft 6 similar to the large flushing valve body 4-1, inside the arms 5-l of the large flushing valve body 4-1.

The arms 5-1 and 5-2 of the large flushing valve body 4-1 and small flushing valve body 4-2 extend to the side opposite the valve bodies 4-1 and 4-2 with respect to the pivotable supports (shafts 6) on the overflow tube 3 and are formed with damping plate-fitting portions 8 at the extended front ends. Damping plates 9-1 and 9-2 (hereinafter referred to as large damping plate and small damping plate, respectively)

are attached to each of the damping plates-fitting portions 8, 8, and while the arms 5-2 of the small flushing valve body 4-2 are formed substantially parallel to each other over the entire length thereof, the arms 5-1 of the large flushing valve body 4-1 are opened outwardly from the pivotable supports on the overflow tube 3 to the damping plate fitting portions 8.

Accordingly, the large damping plate 9-1 can be of transverse width which is larger than the small damping plate 9-2, however, the damping plate 9-1 is formed in the center thereof with a cut-out portion 12 having a width substantially corresponding to the transverse width of the small damping plate 9-2. The small damping plate 9-2 is adapted to be accommodated in the cut-out portion 12 of the above-described large damping plate 9-1.

The above-described large flushing valve body 4-1 and small flushing valve body 4-2 are connected to operating means provided outside the tank body A, by way of operating force-transmitting means 7-1 and 7-2 such as chains, respectively, and can be pulled up from each of the corresponding valve seats 1-1 and 1-2 by operating the operating means.

Operating means for the respective discharge valves B-1 and B-2 for large flushing and small flushing may be provided separately. Alternatively, another construction may be adopted in which a single operating means C may be used and the direction of operation thereof is changed to thereby selectively transmit the operating force to the large flushing valve body 4-1 and the small flushing valve body 4-2.

In the present embodiment, when the operating means is operated to pull up the large flushing valve body 4-1, the large flushing valve body 4-1 is moved away from the large flushing valve seat 1-1 to open the discharge valve B-1 for large flushing, thereby performing large flushing, and when the small flushing valve body 4-2 is pulled up, the small flushing valve body 4-2 is moved away from the small flushing valve seat 1-2 to open the discharge valve B-2 for small flushing, thereby performing small flushing.

The respective motions of the discharge B-1 for large flushing at the time of large flushing and of the discharge valve B-2 for small flushing at the time of small flushing are basically the same as the motion of the discharge valve B in the above-described embodiment; however, since, at the time of large flushing, the small flushing valve body 4-2 remaining in a seating engagement with the small flushing valve seat 1-2 and placed on the large flushing valve body 4-1 performs the same motion as the large flushing valve body 4-1, the large flushing valve body 4-1 is subjected to a force of resistance due to the pressure of the descending flow of flush water, acting on a large area obtained by summing the areas of the large damping plate 9-1 and the small damping plate 9-2.

At the time of small flushing, only the small flushing valve body 4-2 is pulled up and the large flushing valve body 4-1 is kept in a seating engagement with the large flushing valve seat 1-1; so, the small flushing valve body 4-2 is subjected to only a force of resistance due to the small damping plate 9-2.

Namely, since the area of the damping plate acting at the time of small flushing is smaller than the area of the damping plate acting at the time of large flushing, an effect of lessening the delaying of the valve closing time occurs and the valve is closed in a short time compared with the time of large flushing. Therefore, along with the fact that the area of the through-hole 11 of the small flushing valve seat 1-2 is smaller than the area of opening of the large flushing valve seat 1-1, only a small amount of water is discharged at the time of small flushing compared with the time of the large flushing.

Figure 7:
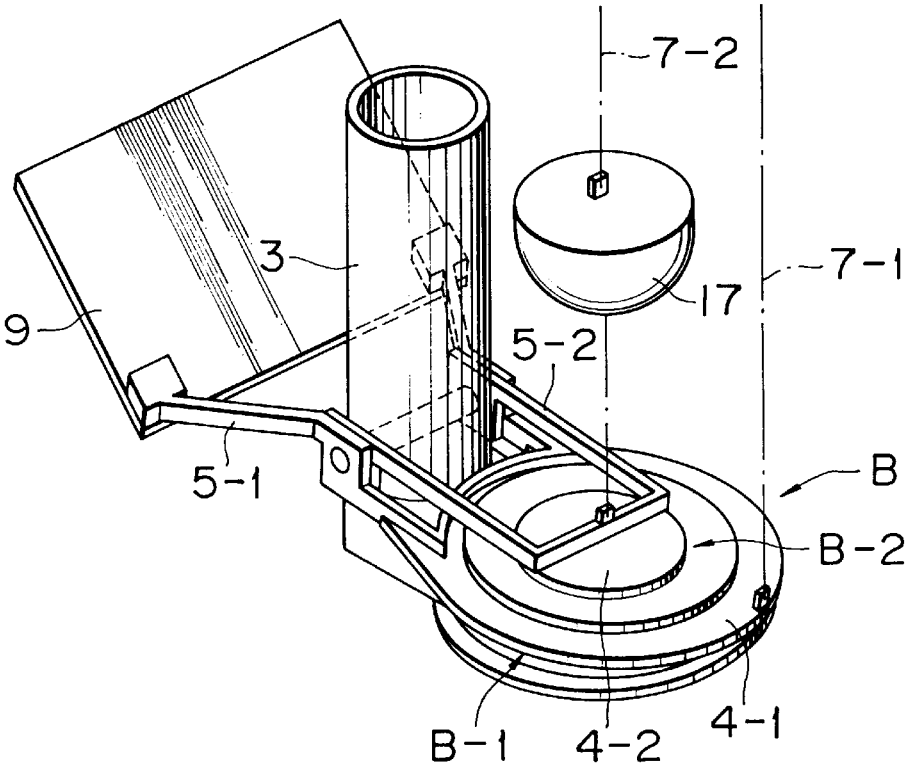
FIG. 7 is a perspective view showing a fourth embodiment of the present invention.

FIG. 7 shows a fourth embodiment of the present invention. This embodiment also can be used with a means for changing between large flushing and small flushing, in a similar way to the embodiment shown in FIGS. 5 and 6.

In this embodiment, a damping plate 9 is provided only in a discharge valve B-1 for large flushing and is not provided in a discharge valve B-2 for small flushing.

Namely, in the discharge valve B-1 for large flushing, support arms 5-1 for supporting a large flushing valve body 4-1 extend to the side opposite the valve body 4-1 with respect to the pivotable supports and the damping plate 9 is attached to the extended front ends in a similar way to the above-described embodiment, while in the discharge valve B-2 for small flushing a float 17 is attached to the middle of an operating force-transmitting means 7-2 which connects a small flushing-valve body 4-2 to an operating means.

Thus, in this embodiment, in the discharge valve B-1 for large flushing, at the time of closing the valve, the descending motion of the large flushing valve body 4-1 is delayed by a resistance of the damping plate 9, while in the discharge valve B-2 for small flushing, at the time of closing the valve, the descending motion of the small flushing valve body 4-2 is delayed by a buoyancy of the float 17.

Every embodiment described above is designed in such a way that the damping plate 9, which is subjected to a pressure of the descending flow of flush water within the tank at the time of water discharge, is provided and the discharge valve B is closed later than when the water level within the tank drops; however, each embodiment described below is designed in such a way that the valve closing motion of the discharge valve B is delayed without using the damping plate 9.

Figure 8:
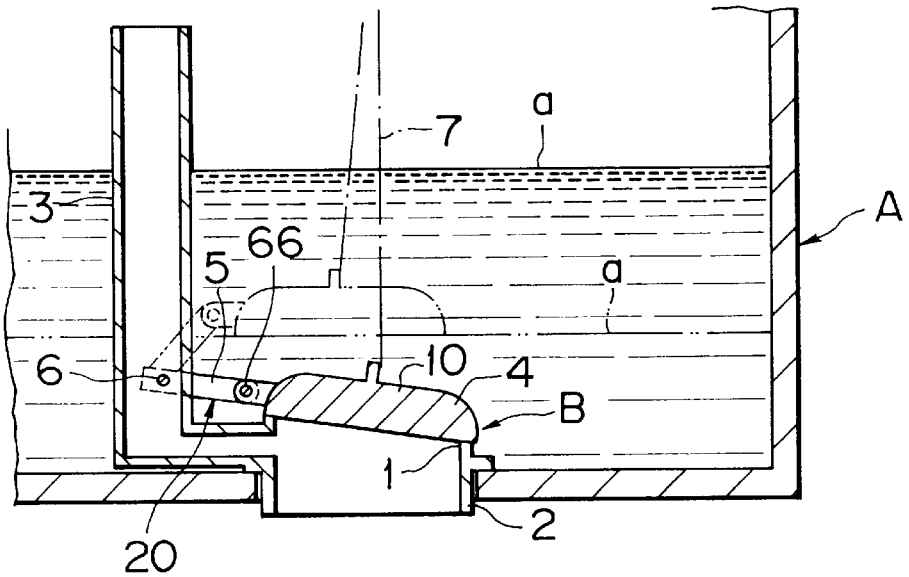
FIG. 8 is a sectional view showing a fifth embodiment of the present invention.

FIG. 8 shows a fifth embodiment of the present invention, in which a discharge valve B which functions to be opened and closed due to the up and down pivotable movement of a valve body 4 is provided, and the above-described discharge valve B and an operating means provided outside a tank body A are connected by way of an operating transmitting member 7. In the present embodiment, the valve body 4 is further fitted to the base of an overflow tube 3 provided on the discharge valve body 2, by way of a link mechanism 20.

Namely, the link mechanism 20 is so constituted that support arms 5 each are pivotably connected at one end thereof to the peripheral surface of the valve body 4 using a shaft 66, and are pivotably connected at the other end to the base of the overflow tube 3 using the shaft 6.

Moreover, the above-described valve body 4 is constructed so as to also serve as a float 10, and is formed so that it has a flat bottom surface and the area thereof is somewhat larger than the area of opening of the valve seat 1.

According to the present embodiment, when the operating means (not shown) is operated to pull up the valve body 4, the pulled-up valve body 4 is horizontally positioned in the water regardless of the water level by means of the link mechanism 20 which constitutes a mechanism for keeping the valve body 4 horizontal.

Thus, when a discharge of water is started and the water level within the tank drops till the water surface "a" reaches a position of the bottom surface of the valve body 4, the valve body 4 drops surely along with the water surface "a", always floating on the water surface, by an adsorbing force produced between the flat bottom surface of the valve body 4 and the water surface due to the surface tension of water, and at last when the water surface "a" drops to a position of the valve seat 1, the valve body 4 is brought into a seating engagement with the valve seat 1, thereby closing the discharge valve B.

In the present embodiment, the bottom surface of the valve body 4 per se is flat; however, it is also possible to cause the valve body 4 to move according to the water level, always floating on the water surface if the valve body 4 is provided at the lower edge thereof with a wider, flange-like responding plate extending horizontally, the bottom surface of which is flat.

In addition, it is not always necessary to constitute the valve body by the float.

Figure 9:
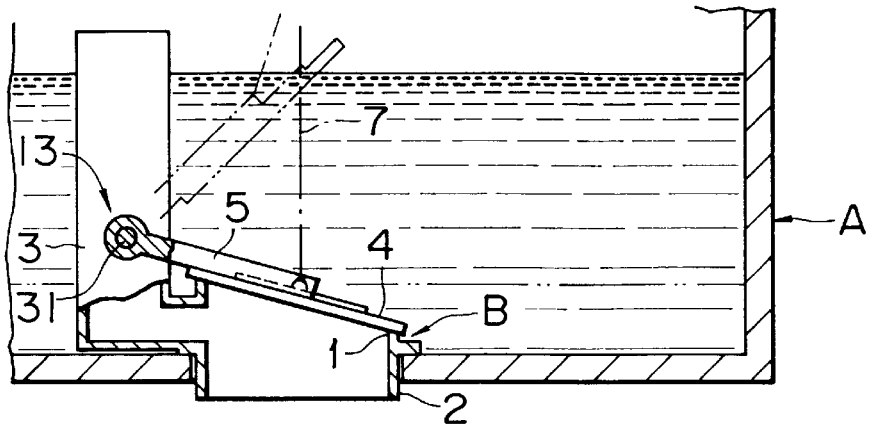
FIG. 9 is a sectional view showing a sixth embodiment of the present invention.
Figure 10:
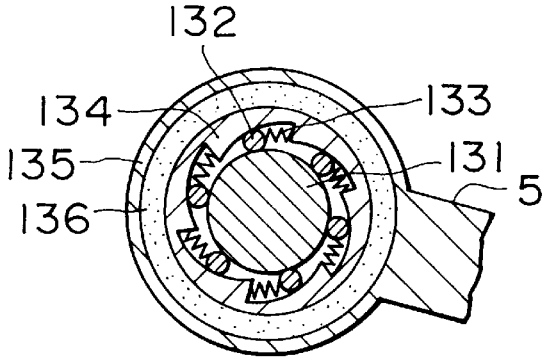
FIG. 10 is an enlarged sectional view showing a damper portion of the embodiment shown in FIG. 9.

FIGS. 9 and 10 show a sixth embodiment of the present invention, in which support arms 5, which support a valve body 4, is pivotably connected to the base of an overflow tube 3 continually provided on a discharge valve body 2, and dampers 13 for delaying a speed of pivotal motion are provided at the pivotably connected portion of the support arms 5 to the overflow tube 3, thus delaying a speed of downward pivotal motion of the support arms 5 by a damping action of the damper 13.

The damper 13 consists of a viscous fluid joint, which comprises a rotor 1-34 provided with a one way clutch consisting of rollers 132 arranged on the outer periphery of a stationary support shaft 131, and springs 133; a driven body 135 provided with a small clearance remaining on the outer periphery of the rotor 134; and viscous fluid 136 poured and filled into a room between the driven body 135 and the rotor 134, said support arms 5 being integrally connected to the driven body 135. To the front ends of the support arms 5 is secured a valve body 4 in the form of a flat plate.

In the case where the support arms 5 are pivotally moved in the downward direction (in the case where the discharge valve B is pivotally moved in the direction of closing the valve), the damper 13 functions in such a way that one way clutch of the rotor 134 works in the direction of operation by an action of shear resistance due to the viscous fluid 136 and a clearance of shear, and transfers to a lock condition, and a resistance works against a downward pivotal motion, thereby producing an action of suppressing the downward pivotal motion of the support arms 5.

Further, as for an upward pivotal motion of the support arms 5 (pivotable motion in the direction of opening the discharge valve B), the clutch of the rotor 134 becomes free and the support arms 5 can be pivotally moved in a smooth and light way in the upward direction.

Accordingly, in this embodiment, when a force of pulling up the valve body 4 by an operating means is released after it is pulled up, the valve body 4 attempts to drop due to its weight and the support arms 5 start to be pivotally moved in the downward direction; however, the valve body 4 drops slowly independently of the water level within the tank, so that the valve closing motion of the discharge valve B is performed in a delayed relation with respect to the drop of the water level within the tank. An amount of water remaining in the tank after a discharge of flush water can, therefore, be surely lessened.

Figure 11:
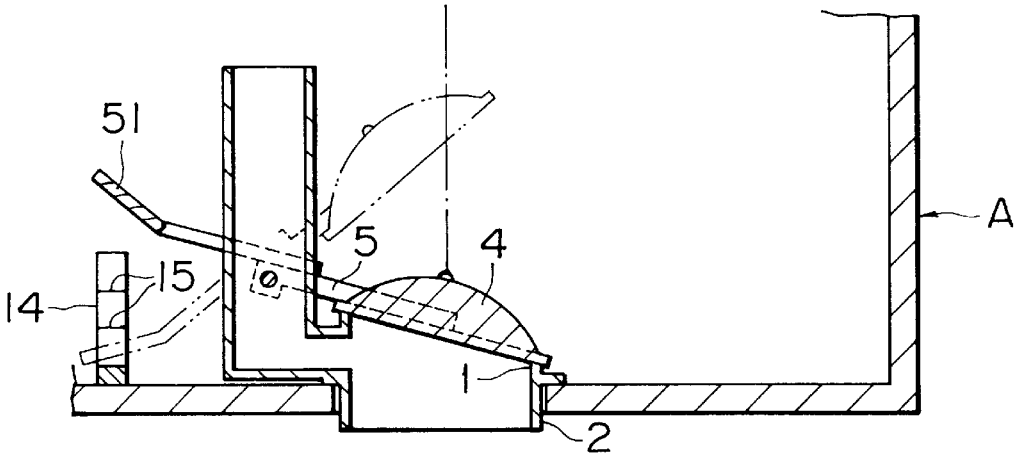
FIG. 11 is a sectional view showing a seventh embodiment of the present invention.
Figure 12:
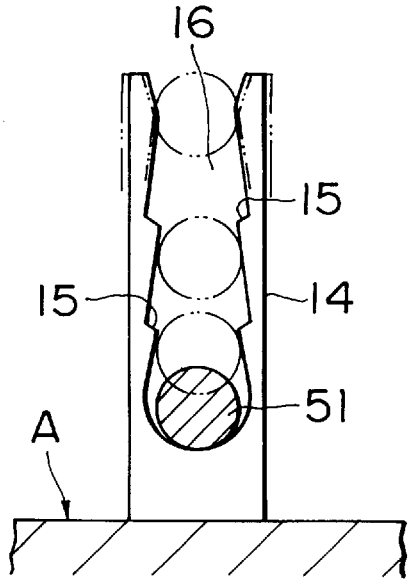
FIG. 12 is an enlarged side view of a the embodiment shown in FIG. 11.

FIGS. 11 and 12 show a seventh embodiment of the present invention, in which the drop of a valve body 4 is controlled by means of a latch mechanism to thereby maintain a degree of opening of a discharge valve B.

Namely, a pair of support arms 5 which support the valve body 4 is pivotably connected to the base of an overflow tube 3 continuously provided on the discharge valve body 2, and extend to the side opposite the valve body with respect to the pivotal connecting portions of the support arms to the overflow tube 3, and the extended front ends are connected with each other in the form of a channel by means of a connecting part 51.

Further, an arm receiving part 14 is provided rising perpendicularly at the bottom of the tank body A in a point where the connecting part 51 at the front ends of the support arms 5 is positioned in a valve opening situation of the discharge valve B. This arm receiving part 14 is formed on the inner surface with a slit 16 having a plurality of latches 15 in the up and down stepped way, said slit 16 being parallel to the connecting part 51 of the above-described support arms 5.

Accordingly, in this embodiment, when the valve body 4 is pulled up by a hand operation to cause the support arms 5 to be pivotally moved in the downward direction, the connecting part 51 at the front ends of the support arms 5 is fitted into the slit 16 of the arm receiving part 14 and is caught by the latches 15 on the inner surface of the slit 16. As a result, the valve opening situation of the discharge valve B is maintained.

When a discharge of water is started and the water level within the tank drops, the buoyancy of the valve body 4 is decreased and the weight of the valve body 4 acts on the latches 15 on the inner surface of the slit 16 of the arm receiving part 14. This causes the connecting part 51 of the support arms 5 to be disengaged from the latches 15 in order, so that the valve body 4 is pivotally moved in the downward direction and drops.

Since the connecting part 51 is disengaged from each of the latches 15 in order along with the drop of the water level and the valve body 4 drops later than the drop of the water level to close the valve, the remaining water within the tank after the discharge of flush water is surely reduced.

Figure 13:
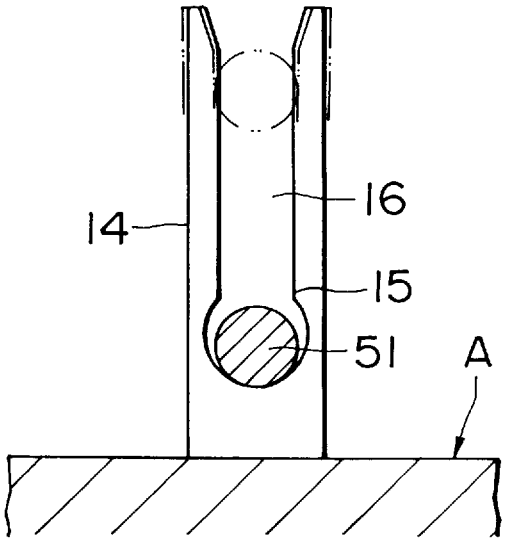
FIG. 13 is a side view showing a modification of the embodiment shown in FIG. 12.

Instead of providing the slit 16 of the above-described arm receiving part 14 on the inner surface thereof with a plurality of latches 15, it is possible to provide the slit 16 at the deepest portion thereof with only one latch 15, as shown in FIG. 13, and to make the width of the slit 16 somewhat narrower over a distance from the latch 15 to the inlet of the slit 16, so that after the connecting part 51 of the support arms 5 is disengaged from the latch 15, a rising speed of the connecting part 51 can be repressed due to a frictional resistance between it and the inner surface of the slit 16.

It is also possible to provide the latch or latches 15 on the lateral surface of the tank body A.

The device according to the present invention, which is of such constructions as described above, provides the advantageous effects described below.

First, with a simple construction in which the damping plate linked to the motion of the valve body of the discharge valve and moving in the direction reverse to the valve body is merely connected to the valve body by way of the support arms, the discharge valve can be supplied with a function of closing the valve later than the drop of the water level within the tank; so, the number of parts is few, and not only low cost can be easily achieved, but also there is no danger of fault and the motion is stabilized.

Moreover, since the valve closing timing can be controlled to some extent by the area of the damping plate or a ratio of the valve body and the damping plate in weight, adjustment of the total amount of water discharged from the discharge valve can be easily made.

In addition, it is also possible to variably adjust a force exerted to the valve body by the pressure of the descending flow applied to the damping plate at the time of water discharge if the length of the extended portions of the arms is adjusted.

Further, since the damping plate is constituted so as to be substantially parallel to the dropped water surface within the tank, the discharge valve allows keeping the valve open at the two step positions to be performed, i.e., one being to keep the valve open due to the pressure of the descending flow of flush water within the tank which acts on the damping plate and the other being to keep the valve open due to an adsorbing force produced between the damping plate and the water surface when the damping plate becomes horizontal to the water surface. Thus, a function of delaying the water discharge is more improved.

With a construction in which the valve is not provided with a float and the buoyancy of the float is not utilized, the valve body is not influenced by the waves of the water surface caused when water is supplied using a water supply mechanism such as a ball-cock supply valve; so, the motion is stabilized.

On the contrary, in the case where a float is attached to the valve body, the drop of the valve body is repressed not only by an action of suppressing the valve closing motion using a resistance of the damping plate, but also by the buoyancy of the float, thereby enabling the damping plate to be made smaller in size.

Moreover, the discharge valve is constructed in such a way that it comprises a discharge valve for large flushing and a discharge valve for small flushing arranged one on top of the other, the valve seat for the discharge valve for small flushing being formed on the valve body of the discharge valve for large flushing and, simultaneously, both discharge valves for large and small flushing being each provided with the damping plate or only the discharge valve for large flushing being provided with the damping plate, the float being attached to the discharge valve for small flushing in the middle of the operating force-transmitting means thereof. With this construction, it is possible to use changing the discharge valve to a large flushing for flushing stool or a small flushing for flushing urine and, in addition, also in the case of any flushing, the damping plate or float acts as a resistance to the motion of the valve body in the valve closing direction, thereby allowing the valve closing of the valve body to be delayed.

Since the valve body of the discharge valve is pivotably connected to the support part within the tank body by means of the link mechanism and the valve body of the discharge valve is adapted to drop always in response to the water surface within the tank, an amount of water remaining in the tank after a discharge of flush water can be surely reduced.

Further, since a dropping speed of the valve body of the discharge valve is decreased using the damper, the valve body pulled up to the valve opening position drops at a certain speed regardless of the water level within the tank and later than the drop of the water level and closes the valve, thereby allowing an amount of water remaining within the tank to be surely reduced.

In addition, since the extended portion of the valve support arms is engaged by the latch or latches provided at the bottom or the lateral surfaces of the tank body to thereby delay the valve closing motion, a function of delaying the water discharge can be obtained with such a simple construction.

The toilet bowl-flushing tank device according to the present invention, when used for flushing a toilet bowl, offers a superior effect of making it possible to save flush water and make the flush water-storing tank smaller in size and lower in height.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

We claim:

1. A tank flushing device for flushing a toilet bowl comprising:

a tank body for storing flush water, said tank body having an opening at a bottom thereof;

a first pivot support mounted within the tank body;

a first support arm arranged for pivoting movement about said first pivot support;

a valve body secured to said first support arm, said valve body lying in a first plane and adapted to come into close contact with said opening at said bottom of said tank body;

a damping plate secured to said first support arm for developing a surface tension with an upper surface of the flush water within the tank body, said damping plate lying in a second plane which is oriented at an angle relative to the first plane of said valve body; and an activator to impart a movement to said valve body relative to said opening at said bottom of said tank body.

2. The tank flushing device according to claim 1, wherein said angle of orientation of said damping plate relative to said valve body is approximately 25 to 50 degrees.

3. The tank flushing device according to claim 1, wherein said first pivot support is located at a position along said first support arm which is between said valve body and said damping plate.

4. The tank flushing device according to claim 1, further comprising:

a second pivot support mounted within the tank body; and a second support arm arranged for pivoting movement about said second pivot support, wherein said valve body is secured to said second support arm and said damping plate is secured to said second support arm.

5. The tank flushing device according to claim 4, wherein said first pivot is located at a position along said first support arm which is between said valve body and said damping plate, and wherein said second pivot is located at a position along said second support arm which is between said valve body and said damping plate.

6. The tank flushing device according to claim 1, wherein a float comprising a structure having a specific gravity smaller than that of water, is attached to said valve body.

7. The tank flushing device according to claim 1, wherein:

said valve body comprises a large flushing valve body having an opening therein, and a small flushing valve body placed on said large flushing valve body and having a shape for closing said opening in said large flushing valve body;

said first support arm being attached to said large flushing valve body;

a second support arm arranged for pivoting movement within said tank body, wherein said small flushing valve body is secured to said second support arm; and said activator comprises a first activator connected to said large flushing valve body to impart a movement to said large flushing valve body relative to said opening at said bottom of said tank body, and a second activator connected to said small flushing valve body to impart a movement to said small flushing valve body relative to said opening in said large flushing valve body.

8. The tank flushing device according to claim 7, wherein a float comprising a structure having a specific gravity smaller than that of water is attached to said small flushing valve body.

9. The tank flushing device according to claim 7, wherein said damping plate comprises:

a first damping plate, said first damping plate being secured to said first support arm, said first damping plate lying in the second plane which is oriented at said angle relative to the first plane of said valve body; and a second damping plate, said second damping plate being secured to said second support arm.

10. The tank flushing device according to claim 9, wherein:

said first damping plate includes a cut-out portion; and said second damping plate also lies in the second plane which is oriented at said angle relative to the first plane of said valve body, and said second damping plate is sized to pass through said cut-out portion in said first damping plate.

11. A tank flushing device comprising:

a valve for closing an opening in a flush water tank, wherein said valve includes: a first flow stopping member having an outer dimension larger than a size of the opening in the flush water tank, said first flow stopping member having a through-hole formed therein; and a second flow stopping member movably mounted to open and close said through-hole in said first flow stopping member, wherein said first manner of activation of said valve entails moving said first flow stopping member relative to the opening in the flush water tank and said second manner of activation entails moving said second flow stopping member relative to said through-hole in said first flow stopping member;

an activator for activating said valve to allow flush water to flow past said valve and through the opening in the flush water tank, wherein said activator can activate said valve in a first manner to allow a first quantity of water to flow past said valve, and said activator can activate said valve in a second manner to allow a second quantity of water, which is less than said first quantity of water, to flow past said valve;

a first pivot support mounted within the flush water tank;

a first support arm arranged for pivoting movement about said first pivot support;

said first flow stopping member secured to said first support arm;

a first damping plate secured to said first support arm for developing a surface tension with an upper surface of the flush water within the tank body; and a second support arm arranged for pivoting movement within said flush water tank, wherein said second flow stopping member is secured to said second support arm.

12. The tank flushing device according to claim 11, wherein said through-hole is centrally located in said first flow stopping member.

13. The tank flushing device according to claim 11, wherein a float comprising a structure having a specific gravity smaller than that of water, is attached to said second flow stopping member.

14. The tank flushing device according to claim 11, wherein said activator comprises a first actuator capable of causing movement of said first flow stopping member relative to the opening in the flush water tank, and a second actuator capable of causing movement of said second flow stopping member relative to the through-hole in said first flow stopping member.

15. The tank flushing device according to claim 11, wherein said activator comprises a single actuator capable of causing movement of said first flow stopping member relative to the opening in the flush water tank and also capable of causing movement of said second flow stopping member relative to the through-hole in said first flow stopping member.

16. The tank flushing device according to claim 11, further comprising:

a second damping plate arm for developing a surface tension with an upper surface of the flush water within the tank body secured to said second support arm.

17. The tank flushing device according to claim 16, wherein:

said first damping plate includes a cut-out portion; and said second damping plate is sized to pass through said cut-out portion in said first damping plate.

* * * * *